US007654525B2

(12) United States Patent
Wang

(10) Patent No.: US 7,654,525 B2
(45) Date of Patent: Feb. 2, 2010

(54) REFLECTIVE SHEET DETECTOR

(75) Inventor: Chih-Yi Wang, Budai Township, Chiayi County (TW)

(73) Assignee: Avision Inc. (TW)

( * ) Notice: Subject to any disclaimer, the term of this patent is extended or adjusted under 35 U.S.C. 154(b) by 275 days.

(21) Appl. No.: 11/882,045

(22) Filed: Jul. 30, 2007

(65) Prior Publication Data

US 2008/0036138 A1 Feb. 14, 2008

(30) Foreign Application Priority Data

Aug. 11, 2006 (TW) ..... 95129487 A

(51) Int. Cl.
*B41F 35/00* (2006.01)

(52) U.S. Cl. ..... 271/265.01; 356/445; 356/446; 250/239

(58) Field of Classification Search ..... 271/265.01, 271/258.01, 259, 265.02; 400/703, 708; 356/445, 446; 250/239; 399/45
See application file for complete search history.

(56) References Cited

U.S. PATENT DOCUMENTS

| | | | | |
|---|---|---|---|---|
| 3,461,302 | A * | 8/1969 | Benson et al. | 250/548 |
| 5,139,339 | A * | 8/1992 | Courtney et al. | 356/446 |
| 5,262,637 | A * | 11/1993 | Cumberledge et al. | 250/223 R |
| 7,018,121 | B2 * | 3/2006 | Barry et al. | 400/708 |
| 2005/0201808 | A1 * | 9/2005 | Barry et al. | 400/679 |

* cited by examiner

*Primary Examiner*—Kaitlin S Joerger

(57) ABSTRACT

A reflective sheet detector includes first and second guide plates constituting a sheet travelling path, an emitter, a receiver and a reflecting portion. The emitter is disposed on a first side of the sheet travelling path and close to a first input opening of the first guide plate. The receiver is disposed on the first side and close to a first output opening of the first guide plate. The reflecting portion is disposed on a second side of the sheet travelling path opposite the first side and is close to the second guide plate. The emitter outputs a signal to the reflecting portion through the first input opening and a second input opening of the second guide plate, and the reflecting portion reflects the signal to the receiver through a second output opening of the second guide plate and the first output opening.

12 Claims, 4 Drawing Sheets

REFLECTIVE SHEET DETECTOR

BACKGROUND OF THE INVENTION

1. Field of Invention

The invention relates to a sheet detector, and more particularly to an infrared reflective sheet detector.

2. Related Art

In an automatic sheet feeder, a sheet detector for detecting the position of a sheet is an indispensable element. When the sheets that may be transported by the automatic sheet feeder are getting more and more diversified, the effect of the sheet detector for detecting the sheet significantly influences the operation of the automatic sheet feeder.

FIGS. 1 to 3 are schematic illustrations showing a conventional sheet detector 100. Referring to FIG. 1, the conventional sheet detector 100 includes a first guide plate 110, a second guide plate 120, an emitter 130, a receiver 140 and a reflecting mirror 150. The first guide plate 110 and the second guide plate 120 constitute a sheet travelling path 102. When no sheet is traveling in the sheet travelling path 102, a signal S outputted from the emitter 130 penetrates through a first opening 112 of the first guide plate 110 and a second opening 122 of the second guide plate 120, and then the reflecting mirror 150 reflects the signal S to the receiver 140 through the second opening 122 and the first opening 112.

As shown in FIG. 2, when a sheet 104 is traveling in the sheet travelling path 102, the signal S outputted from the emitter 130 is received by the sheet 104 and cannot be reflected to the receiver 140.

However, when the sheet 104 has a smooth surface or the sheet 104 is distorted, as shown in FIG. 3, a scattered signal S' is generated and received by the receiver 140. Thus, the sheet detector has a malfunction.

Thus, it is an important object of the invention to provide a sheet detector which is free from the malfunction caused by the variations in the essence of the sheets.

SUMMARY OF THE INVENTION

It is therefore an object of the invention to provide a reflective sheet detector for effectively preventing a malfunction being caused by the variations in the essence of sheets.

To achieve the above-mentioned object, the invention provides a reflective sheet detector. The reflective sheet detector includes a first guide plate, a second guide plate, an emitter, a receiver and a reflecting portion. The first guide plate and the second guide plate constitute a sheet travelling path. The first guide plate is formed with a first input opening and a first output opening. The second guide plate is formed with a second input opening and a second output opening. The emitter is disposed on a first side of the sheet travelling path and is close to the first input opening of the first guide plate. The receiver is disposed on the first side of the sheet travelling path and is close to the first output opening of the first guide plate. The reflecting portion is disposed on a second side of the sheet travelling path opposite the first side and is close to the second guide plate. The emitter outputs a signal to the reflecting portion through the first input opening and the second input opening, and the reflecting portion reflects the signal to the receiver through the second output opening and the first output opening.

In the above-mentioned aspect, the second input opening and the second output opening may be merged into one single opening.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
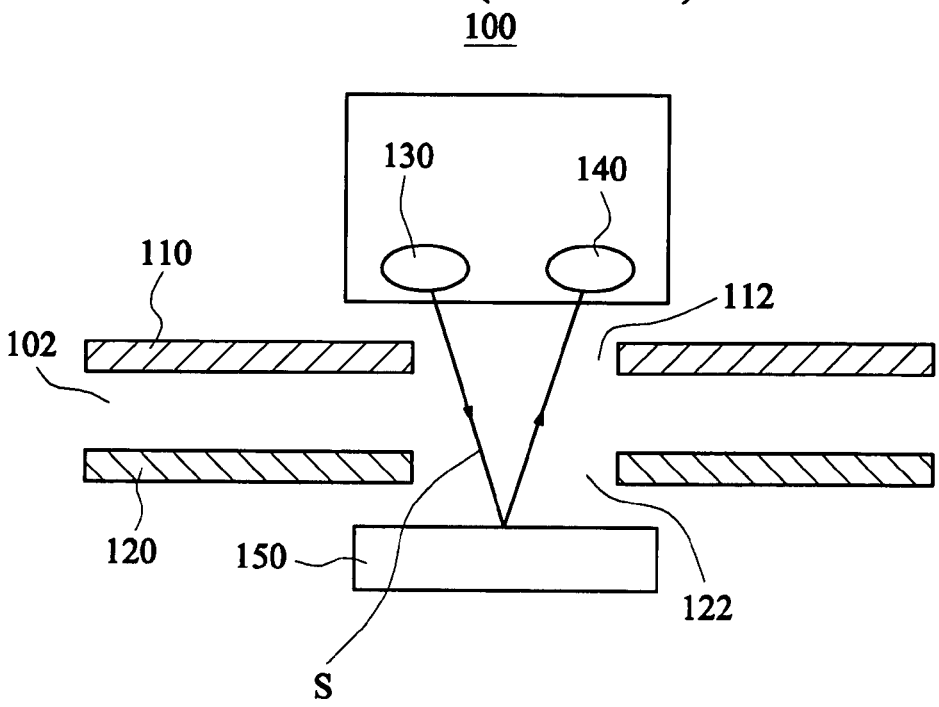
FIG. 1 (Prior Art)
FIGS. 1 to 3 are schematic illustrations showing a conventional sheet detector.
Figure 2:
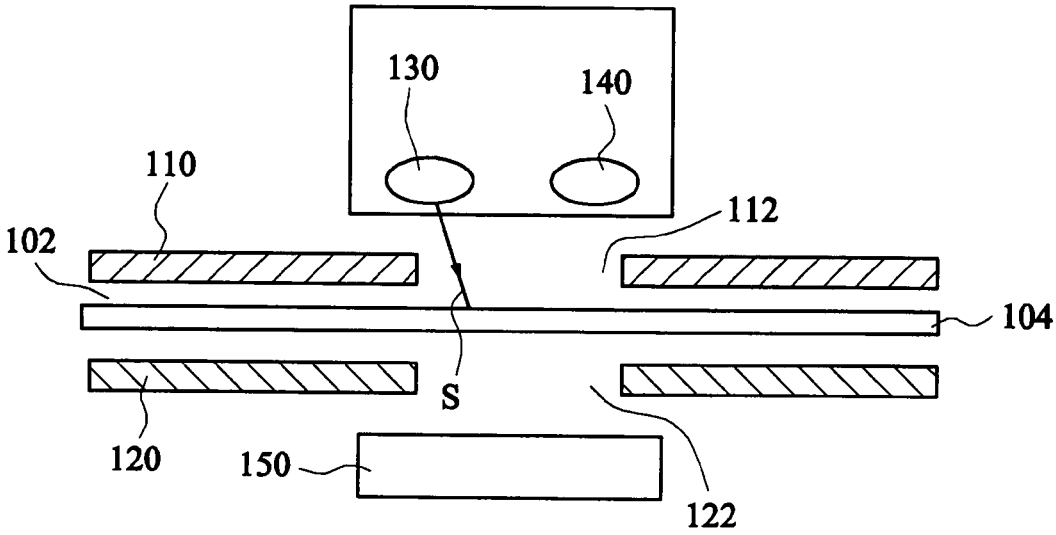
FIG. 2 (Prior Art)
Figure 3:
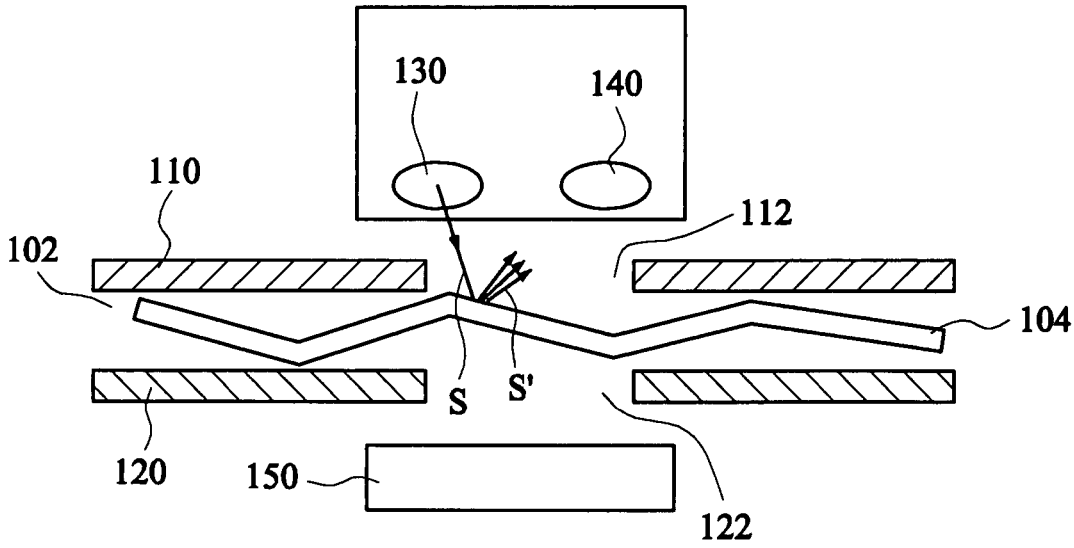
FIG. 3 (Prior Art)
Figure 4:
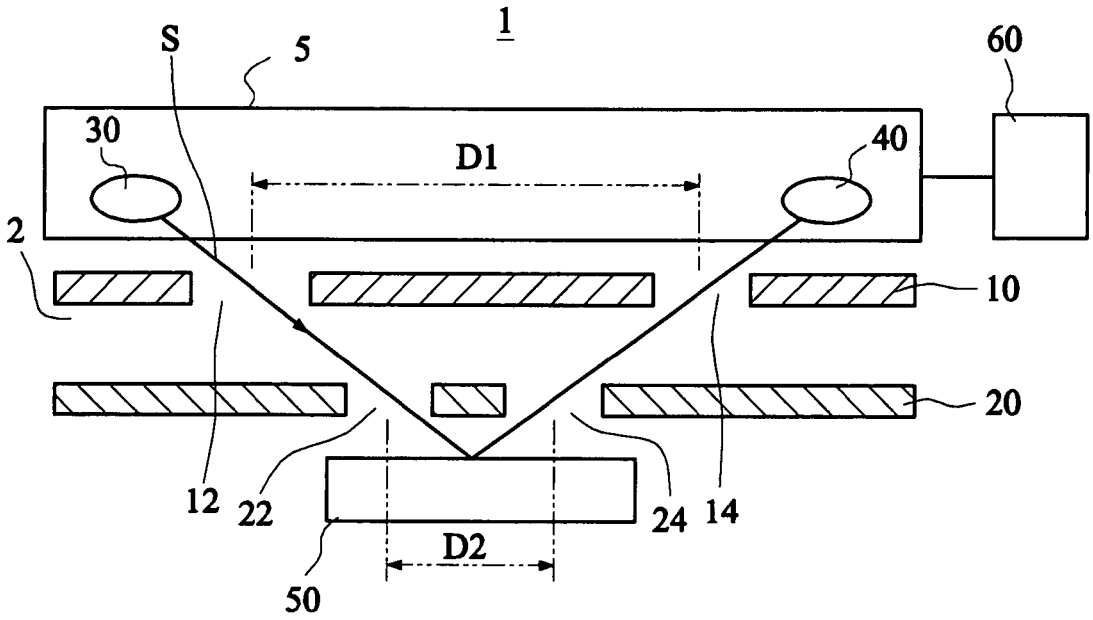
FIGS. 4 to 5 are schematic illustrations showing a sheet detector according to a first embodiment of the invention.
Figure 5:
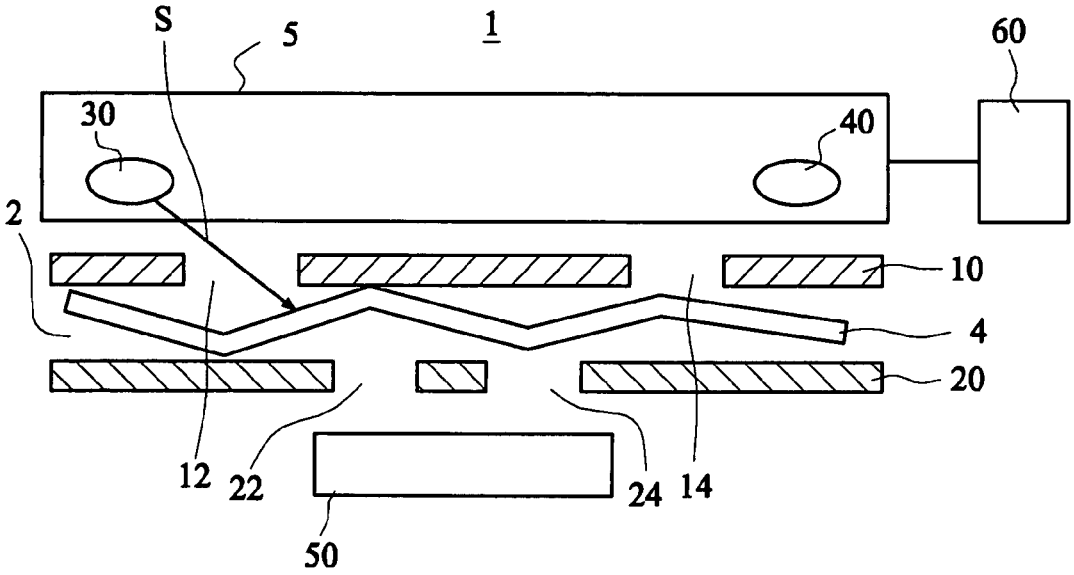

FIGS. 4 to 5 are schematic illustrations showing a reflective sheet detector 1 according to a first embodiment of the invention. Referring to FIGS. 4 and 5, the reflective sheet detector 1 includes a first guide plate 10, a second guide plate 20, an emitter 30, a receiver 40 and a reflecting portion 50.

The first guide plate 10 and the second guide plate 20 constitute a sheet travelling path 2. The first guide plate 10 is formed with a first input opening 12 and a first output opening 14. The second guide plate 20 is formed with a second input opening 22 and a second output opening 24. A first distance D1 from the first input opening 12 to the first output opening 14 is greater than a second distance D2 from the second input opening 22 to the second output opening 24.

The emitter 30 is disposed on a first side of the sheet travelling path 2 and is close to the first input opening 12 of the first guide plate 10. The receiver 40 is disposed on the first side of the sheet travelling path 2 and is close to the first output opening 14 of the first guide plate 10. The emitter 30 may be an infrared emitter for outputting infrared signals, an ultrasonic emitter for outputting ultrasonic signals or a laser beam emitter for outputting laser beam signals. The receiver 40 may be an infrared receiver for receiving the infrared signals, an ultrasonic receiver for receiving the ultrasonic signals or a laser beam receiver for receiving the laser beam signals.

The reflecting portion 50 is usually a reflecting mirror which is disposed on a second side of the sheet travelling path 2 opposite the first side and is close to the second guide plate 20.

When no sheet is traveling in the sheet travelling path 2, as shown in FIG. 4, the emitter 30 outputs a signal S to the reflecting portion 50 through the first input opening 12 and the second input opening 22, and the reflecting portion 50 reflects the signal S to the receiver 40 through the second output opening 24 and the first output opening 14.

When the sheet is traveling in the sheet travelling path 2, as shown in FIG. 5, the emitter 30 outputs the signal S to the sheet 4 through the first input opening 12. Because the middle section of the first guide plate 10 blocks the signal which is either reflected or absorbed by the sheet, the signal S never reaches the receiver 40. Thus, it is possible to prevent the reflective sheet detector 1 from misjudgment.

The reflective sheet detector 1 may further include an adjusting mechanism 60, connected to the emitter 30 and the receiver 40, for adjusting positions of the emitter 30 and the receiver 40 laterally, for example. The adjusting mechanism 60 may be achieved using an adjustment screw or a motor. In one example, the emitter 30 and the receiver 40 may be moved relative to each other, and the adjusting mechanism 60 adjusts the positions of the emitter 30 and the receiver 40 individually. Alternatively, the emitter 30 and the receiver 40 may be mounted on a base 5 and cannot be moved relative to each other, and the adjusting mechanism 60 can adjust the position of the base 5 and thus to adjust the positions of the emitter 30 and the receiver 40 synchronously. In addition, for adjusting the position of the reflecting portion 50, another adjusting mechanism may be provided or the adjusting mechanism 60 may be utilized.

Figure 6:
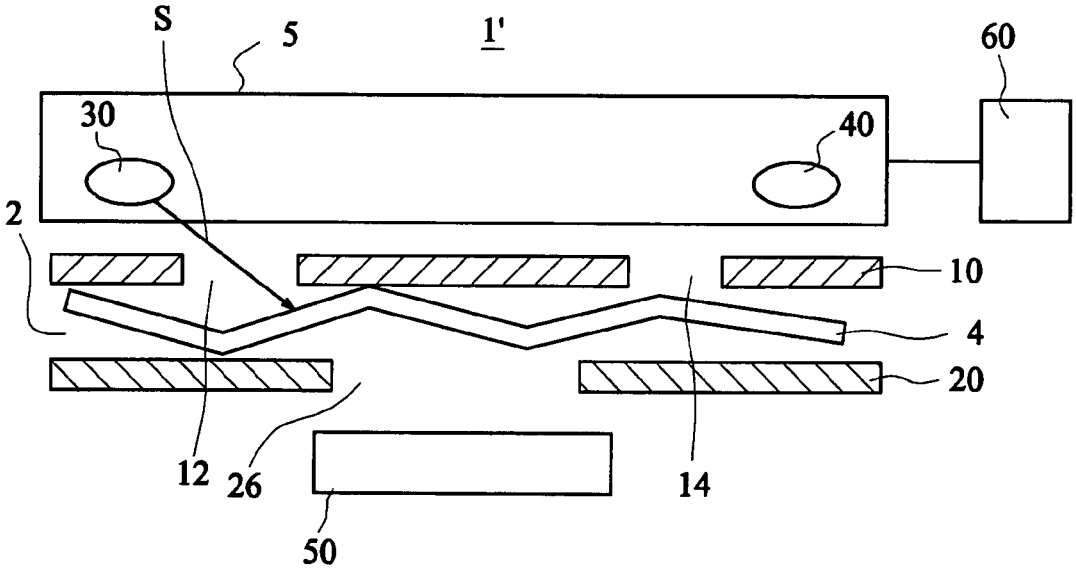
FIG. 6 is a schematic illustration showing a sheet detector according to a second embodiment of the invention.

FIG. 6 is a schematic illustration showing a reflective sheet detector 1' according to a second embodiment of the invention. As shown in FIG. 6, the reflective sheet detector 1' of this embodiment is similar to the first embodiment except that the second guide plate 20 is formed with only one single opening 26. When no sheet is traveling in the sheet travelling path 2, the emitter 30 outputs a signal S to the reflecting portion 50 through the first input opening 12 and the opening 26 of the second guide plate 20, and the reflecting portion 50 reflects the signal S to the receiver 40 through the opening 26 and the first output opening 14.

Figure 7:
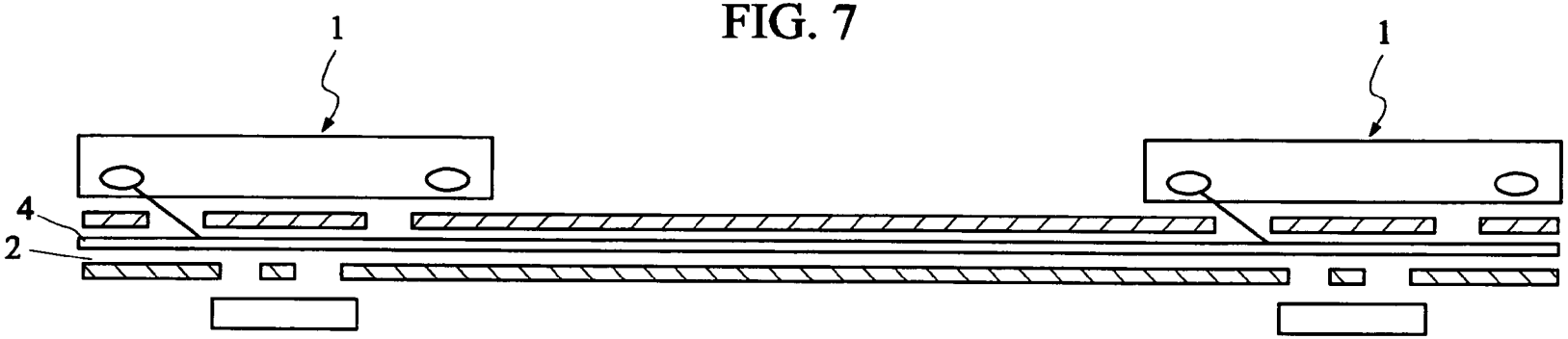
FIG. 7 is a schematic front view showing a skew detecting module of the sheet detector of the invention.
Figure 8:
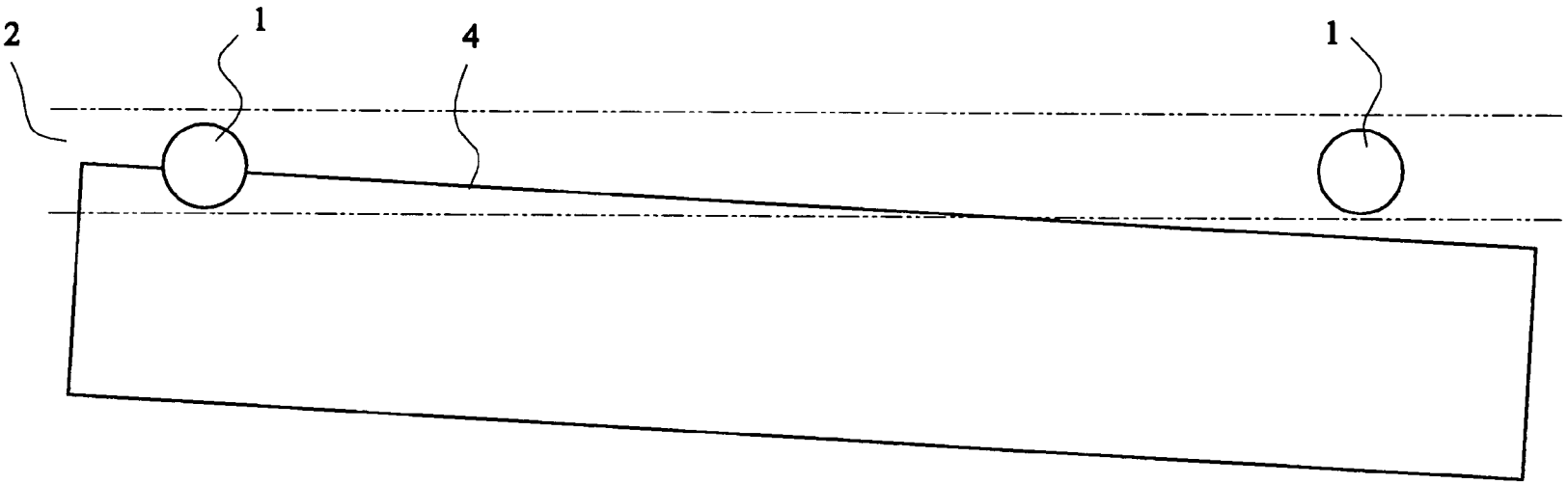
FIG. 8 is a schematic top view showing a skew detecting module of the sheet detector of the invention.

FIG. 7 is a schematic front view showing a skew detecting module of the sheet detector of the invention. FIG. 8 is a schematic top view showing a skew detecting module of the sheet detector of the invention. As shown in FIGS. 7 and 8, the skew detecting module includes two reflective sheet detectors 1, disposed on the same side of the sheet traveling path 2, for respectively detecting the instance when the leading edge of the sheet 4 moves across the two reflective sheet detectors 1. Thus, the skew of the sheet can be detected and can then be calibrated. Alternatively, the two reflective sheet detectors 1 may be disposed on either side of the sheet traveling path 2.

According to the sheet detector of the invention, the detection range of the receiver for receiving the signal is greatly restricted so that no mis-judgement can be made when the sheet is deformed or has a smooth surface. Thus, the sheet detector of the invention can be applied in a diversity of products.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A reflective sheet detector, comprising:

a first guide plate and a second guide plate constituting a sheet travelling path, wherein the first guide plate is formed with a first input opening and a first output opening, and the second guide plate is formed with a second input opening and a second output opening;

an emitter disposed on a first side of the sheet travelling path and close to the first input opening of the first guide plate;

a receiver disposed on the first side of the sheet travelling path and close to the first output opening of the first guide plate; and a reflecting portion, which is disposed on a second side of the sheet travelling path opposite the first side and is close to the second guide plate, wherein the emitter outputs a signal to the reflecting portion through the first input opening and the second input opening, and the reflecting portion reflects the signal to the receiver through the second output opening and the first output opening.

2. The detector according to claim 1, wherein the signal is one of an infrared signal, an ultrasonic signal and a laser beam signal.

3. The detector according to claim 1, wherein a first distance from the first input opening to the first output opening is greater than a second distance from the second input opening to the second output opening.

4. The detector according to claim 1, further comprising:

an adjusting mechanism, connected to the emitter and the receiver, for adjusting positions of the emitter and the receiver.

5. The detector according to claim 4, wherein the adjusting mechanism adjusts the positions of the emitter and the receiver individually.

6. The detector according to claim 4, wherein the adjusting mechanism adjusts the positions of the emitter and the receiver synchronously.

7. The detector according to claim 4, wherein the adjusting mechanism further adjusts a position of the reflecting portion.

8. A reflective sheet detector, comprising:

a first guide plate and a second guide plate constituting a sheet travelling path, wherein the first guide plate is formed with an input opening and an output opening, and the second guide plate is formed with an opening;

an emitter disposed on a first side of the sheet travelling path and close to the input opening of the first guide plate;

a receiver disposed on the first side of the sheet travelling path and close to the output opening of the first guide plate; and a reflecting portion, which is disposed on a second side of the sheet travelling path opposite the first side and is close to the second guide plate, wherein the emitter outputs a signal to the reflecting portion through the input opening and the opening of the second guide plate, and the reflecting portion reflects the signal to the receiver through the opening of the second guide plate and the output opening; and an adjusting mechanism, connected to the emitter and the receiver, for adjusting positions of the emitter and the receiver.

9. The detector according to claim 8, wherein the adjusting mechanism adjusts the positions of the emitter and the receiver individually.

10. The detector according to claim 8, wherein the adjusting mechanism adjusts the positions of the emitter and the receiver synchronously.

11. The detector according to claim 8, wherein the adjusting mechanism further adjusts a position of the reflecting portion.

12. The detector according to claim 8, wherein the signal is one of an infrared signal, an ultrasonic signal and a laser beam signal.

* * * * *